United States Patent [19]

Geus et al.

[11] 4,196,369

[45] Apr. 1, 1980

[54] TELEVISION CAMERA TUBE WITH CONDUCTIVE OR SECONDARY EMISSIVE REGION BETWEEN WINDOW SEAL AND MESH

[75] Inventors: Jacob H. Geus; Louis M. Swart, both of Eindhoven, Netherlands

[73] Assignee: U.S. Philips Corporation, New York, N.Y.

[21] Appl. No.: 786,047

[22] Filed: Apr. 8, 1977

[30] Foreign Application Priority Data

Apr. 12, 1976 [NL] Netherlands ..... 7603830

[51] Int. Cl.[2] ..... H01J 29/62; H01J 31/38

[52] U.S. Cl. ..... 313/365; 313/384

[58] Field of Search ..... 313/371, 372, 365, 384, 313/478, 373, 385, 390, 386, 450, 479, 388, 389; 358/252

[56] References Cited

U.S. PATENT DOCUMENTS

| | | | |
|---|---|---|---|
| 3,047,758 | 7/1962 | Rome et al. | 313/450 |
| 3,300,669 | 1/1967 | Jordan | 313/388 |
| 3,376,446 | 4/1968 | De Haan et al. | 313/385 |
| 3,569,763 | 3/1971 | Kiuchi et al. | 313/386 |
| 3,801,855 | 4/1974 | Gerlach | 315/14 |
| 3,857,037 | 12/1974 | Tomii et al. | 313/390 X |
| 4,079,286 | 3/1978 | Popp | 313/389 |

*Primary Examiner*—Robert Segal

*Attorney, Agent, or Firm*—Algy Tamoshunas

[57] ABSTRACT

In order to avoid picture disturbances by electric charging phenomena on the tube wall in a camera tube in which no target material is present on the inner wall of the cylinder tube, the tube wall is provided with a surface potential stabilizing material between the window connection and the mesh electrode of the camera tube. This stabilization can be realized by way of a local cover layer having the desired electric conductivity or secondary emission properties, or by locally adapting properties of the glass of the tube wall thereto.

3 Claims, 2 Drawing Figures

TELEVISION CAMERA TUBE WITH CONDUCTIVE OR SECONDARY EMISSIVE REGION BETWEEN WINDOW SEAL AND MESH

The invention relates to a camera tube comprising an entrance window and a cylinder tube, in which no target material is present on the inner wall of the cylinder tube after the provision of a photosensitive target, the camera tube comprising an electron gun, provided with a mesh electrode, for generating an electron beam which scans the target.

In camera tubes of this kind picture disturbances occur which become manifest in a picture to be formed as a pattern of, for example, annular regions containing more or less signal. This is a very disturbing phenomenon, notably in pictures with a comparatively low light level.

The invention is based on the discovery that this disturbing phenomenon is caused by electric charging phenomena on a wall portion of the camera tube near the transition between the entrance window and the cylinder tube. The electric charging is caused by electrons which are dispersed by the mesh electrode or by secondary electrons generated on the mesh electrode. During the scanning motion of the electron beam across the target, local charge variations occur which give rise, via capacitive coupling, to the said disturbance. In camera tubes in which the target is mounted only after the entrance window has been connected to the cylindrical tube, a part of the tube wall adjoining the target is always unintentionally covered more or less with target material. This forms a local resistance layer, so that the relevant disturbance does not occur at this area.

The invention has for its object to provide a camera tube of the described type in which this picture disturbance does not occur; to this end, a camera tube in accordance with the invention is characterized in that a part of the cylinder jacket is provided with a surface potential stabilizing material near the connection between window and cylinder tube and the mesh electrode.

As a result of the potential-stabilizing properties of the relevant tube wall portion, the varying electric charge phenomena will not occur in a camera tube in accordance with the invention, so that the picture disturbance is avoided.

In a preferred embodiment of a camera tube in accordance with the invention, the relevant tube wall portion is covered with either a layer of resistance material or with a layer or material having a secondary emission coefficient which becomes larger than 1 only for a surface potential which exceeds the mesh potential. In a further preferred embodiment, at least the portion of the tube wall which adjoins the seal is made of a conductive glass.

Figure 1:
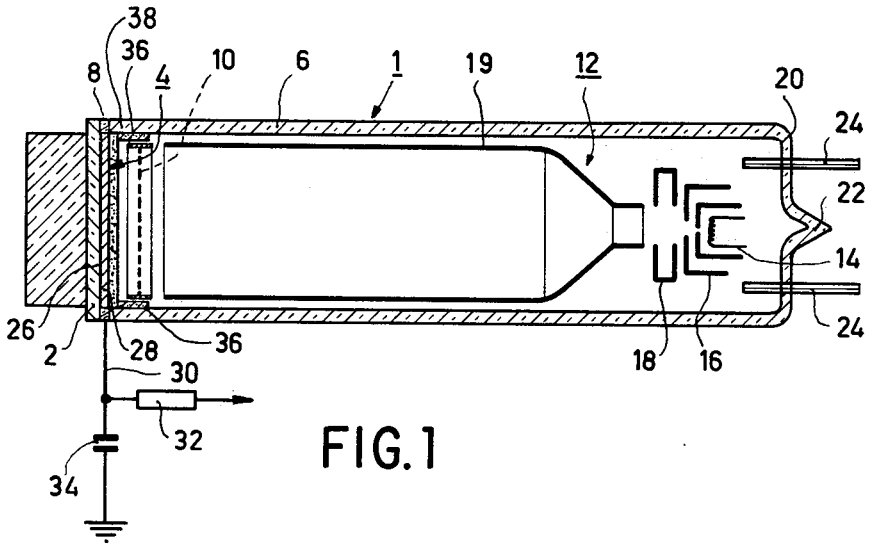
Figure 2:
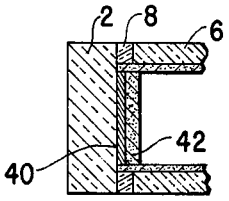

Some preferred embodiments in accordance with the invention will be described in detail hereinafter with reference to the accompanying diagrammatic drawing in which, FIG. 1 shows a camera tube comprising a seal and a slightly electrically conductive cover layer on the tube wall near the seal; and FIG. 2 show another embodiment in which the target is mounted by separate support.

A camera tube 1 as shown comprises an entrance window 2 with a target 4 and a cylindrical tube 6 which is connected to the entrance window by way of a seal 8.

Opposite the target there is arranged a mesh electrode 10 which forms part of an electron gun 12 which furthermore comprises a filament 14, a control grid 16, a first anode 18 and an end anode 19. In a tube base 20 there are provided a pumping stem 22 and passage pins 24 for supplying the necessary power to the various electrodes and the filament of the electron gun.

A target for a camera tube of this kind usually comprises a signal electrode 26 and a photosensitive layer 28. The signal electrode 26 is connected, via an electrical passage 30 which in this case preferably extends via the seal, to a signal pick-up circuit which includes a signal resistor 32 and a signal capacitor 34. The signal electrode preferably consists of a layer of tin oxide or indium oxide or of a mixture thereof which combines suitable electrical conductivity with low light absorption. The photosensitive material of the target may consist of photoconductive material, such as antimony trisulphide or lead monoxide, as well as of, for example, piezoelectric material such as TGS for infrared-sensitive camera tubes. The material whereby the entrance window 2, already provided with a target, is connected to the cylindrical tube 6 consists, for example, of an indium alloy or an other suitable sealing material. Usually, notably the signal electrode 26 will be in contact with the material of the seal, but this need not always be so. In accordance with the invention, an electrically conductive layer 36 is provided on the inner jacket of the cylinder wall as from the seal or, if necessary if the sealing seam insulates, over the seal as far as the signal electrode. This cover layer extends approximately as far as the mesh electrode. Electrical contact between the resistance layer and the mesh electrode should be carefully avoided. This is because the mesh electrode carries a potential other than that of the target during operation. In order to minimize the contribution to the parasitic capacitance relative to the mesh electrode, it is desirable to minimize the electrode conductivity of the cover layer, i.e. to make it just high enough to ensure an adequate potential-stabilizing effect. A resistance layer of this kind may consist, for example, of carbon, tin oxide, tungsten oxide etc., but can also be formed of a, usually semiconductor, material which is used to form the photosensitive layer of the target.

The cover layer in a further preferred embodiment consists of a material whose secondary emission coefficient at the most equals 1, at least as long as the potential of the surface thereof is lower than the potential of the mesh electrode. During operation of the tube, the relevant wall portion is not charged, because at a secondary emission coefficient of less than 1 or at the most equal to 1 no charging in a positive sense can occur, i.e. in the direction of the mesh potential. The compromise between on the one hand a non-excessive, high value of the electric conductivity in view of the contribution to the capacitance and on the other hand a non-excessively low value in view of the stabilising effect, is thus dispensed with. Conductivity and optimum effect can now be separately optimized.

The tube wall in a further preferred embodiment consists, at least at the area of the seal, of a conductive glass 38 or of a type of glass whose secondary emission satisfies the requirement to be imposed. In the case of a favourable compromise, the entire cylindrical portion of the housing can alternatively be made of a type of glass having one of the desired properties.

Like for camera tubes comprising a seal between the window and the cylindrical tube as described, the invention can also be effectively used for camera tubes comprising a target which is mounted on a separate support 40, and for camera tubes comprising a target which is constructed as a disk 42 of semiconductor material comprising a mosaic of p-n transitions which is mounted in the camera tube as such.

In a camera tube with auxiliary illumination as described, for example, in U.S. Pat. Nos. 3,978,365 and 4,019,083, in which selective excess illumination can occur due to reflection from the glass wall near the target, a cover layer in accordance with the invention can also be used for locally reducing the reflection.

What is claimed is:

1. A camera tube comprising an entrance window sealed to one end of a cylindrical tube, a photosensitive target mounted opposite the inner surface of the window, an electron gun for generating an electron beam which scans the target, a mesh electrode spaced from the target in the path of the electron beam and a surface potential stabilizing layer of a material having a secondary emission coefficient which is lower than one as long the surface potential at said layer is lower than the mesh potential, said layer extending on the inner surface of the cylindrical tube between the window and the mesh electrode.

2. A camera tube comprising an entrance window sealed to one end of a cylindrical tube, a photosensitive target mounted opposite the inner surface of the window, an electron gun for generating an electron beam which scans the target and a mesh electrode spaced from the target in the path of the electron beam, wherein the cylindrical tube portion is comprised, at least between the window seal and the mesh electrode, of an electrically conductive glass.

3. A camera tube comprising an entrance window sealed to one end of a cylindrical tube, a photosensitive target mounted opposite the inner surface of the window, an electron gun for generating an electron beam which scans the target and a mesh electrode spaced from the target in the path of the electron beam, wherein the cylindrical tube portion is comprised, at least between the window seal and the mesh electrode, of glass having a secondary emission coefficient lower than one as long as the surface potential at that portion of the cylindrical tube is lower than the mesh potential.

* * * * *

UNITED STATES PATENT AND TRADEMARK OFFICE

CERTIFICATE OF CORRECTION

PATENT NO. : 4196369

DATED : April 1, 1980

INVENTOR(S) : JACOB H. GEUS ET AL

It is certified that error appears in the above-identified patent and that said Letters Patent are hereby corrected as shown below:

In the claims:

Claim 1, line 8, after "long" insert --as--.

Signed and Sealed this

*Twenty-fourth* Day of *June 1980*

[SEAL]

*Attest:*

SIDNEY A. DIAMOND

*Attesting Officer*

*Commissioner of Patents and Trademarks*